US008798493B2

(12) United States Patent
Watanabe

(10) Patent No.: US 8,798,493 B2
(45) Date of Patent: Aug. 5, 2014

(54) IMAGE FORMING APPARATUS

(75) Inventor: Kanehiro Watanabe, Kanagawa (JP)

(73) Assignee: Konica Minolta Business Technologies, Inc. (JP)

( * ) Notice: Subject to any disclaimer, the term of this patent is extended or adjusted under 35 U.S.C. 154(b) by 86 days.

(21) Appl. No.: 13/545,070

(22) Filed: Jul. 10, 2012

(65) Prior Publication Data

US 2013/0016992 A1 Jan. 17, 2013

(30) Foreign Application Priority Data

Jul. 11, 2011 (JP) ..... 2011-152722

(51) Int. Cl.
*G03G 21/20* (2006.01)
*G03G 15/04* (2006.01)
*G03G 15/08* (2006.01)

(52) U.S. Cl.
CPC ..... *G03G 15/04036* (2013.01); *G03G 21/206* (2013.01); *G03G 15/0896* (2013.01)
USPC ..... 399/92; 399/216

(58) Field of Classification Search
CPC ..... G03G 21/206; G03G 15/04036
USPC ..... 399/92, 216
See application file for complete search history.

(56) References Cited

U.S. PATENT DOCUMENTS

| | | | | |
|---|---|---|---|---|
| 6,501,922 | B2 * | 12/2002 | Ihara et al. | 399/92 |
| 2002/0089582 | A1 | 7/2002 | Chikano | |
| 2007/0071484 | A1 * | 3/2007 | Igarashi | 399/92 |
| 2007/0146827 | A1 * | 6/2007 | Kakita | 358/498 |

FOREIGN PATENT DOCUMENTS

| | | | | |
|---|---|---|---|---|
| EP | 1657599 | A1 | 5/2006 | |
| JP | 11-95520 | A | 4/1999 | |
| JP | 2004294949 | A * | 10/2004 | G03G 21/20 |
| JP | 2005-148290 | A | 6/2005 | |
| JP | 2006-343607 | A | 12/2006 | |
| JP | 2010-276983 | A | 12/2010 | |

OTHER PUBLICATIONS

Extended European Search Report; Application No. 12175069; Date of Mailing: Feb. 5, 2013.

Partial European Search Report for Application No./Patent No. 12175069-2216; Date of Mailing: Nov. 9, 2012; Date Received: Nov. 14, 2012.

Notification of Rejection Reason(s) for Japanese Patent Application No. 2011-152722; Date Dispatched: Oct. 15, 2013; w/English Translation.

* cited by examiner

*Primary Examiner* — Benjamin Schmitt
(74) *Attorney, Agent, or Firm* — Cantor Colburn LLP

(57) ABSTRACT

An image forming apparatus includes a main body, exposing portions each forming a latent image on a photosensitive drum based on image data by driving of a polygon motor, developing portions each developing the latent image formed on each of the exposing portions using toner, and a partition member provided between each of the exposing portions and each of the developing portions. Projecting portions each including the polygon motor project from the partition member toward a side of the developing portion. Each of the projection portions is overlapped with at least a part of each of the developing portions on a vertical direction. The cooled air flows to the overlap portion in which the polygon motor of each of the exposing portions and each of the developing portions are overlapped.

4 Claims, 5 Drawing Sheets

IMAGE FORMING APPARATUS

CROSS REFERENCE TO RELATED APPLICATION

The present invention contains subject matter related to Japanese Patent Application JP 2011-152722 filed in the Japanese Patent Office on Jul. 11, 2011, the entire contents of which being incorporated herein by reference.

BACKGROUND OF THE INVENTION

1. Field of the Invention

The present invention relates to an image forming apparatus that forms an image on a sheet of paper, such as a copy machine, a facsimile and a printer.

2. Description of Related Art

An image forming apparatus equipped with multiple functions, which is simultaneously provided with various functions such as a printer, a scanner, a copy machine and a facsimile, has been widely used in recent years. In such an image forming apparatus, an exposing portion provided at each color forms a latent image on a surface of the photosensitive drum corresponding the color based on image data and then, a developing portion develops the latent image by using toner contained in the developing portion. Respective toner images formed on the photosensitive drums of respective colors are transferred to a image-forming position of an intermediate transfer belt and then, by transferring the toner images formed on the intermediate transfer belt to a sheet of paper conveyed from a paper feed tray, a desired color image is formed on the sheet of paper.

By the way, in an electrophotographic image forming apparatus, a temperature rises within the apparatus by any heating elements used during an image forming process, any movable members, which move accompanying any friction heat, and/or the like. This rise in temperature may have an influence on the image forming process. For example, in the developing portion, a friction heat is subject to occurrence on a bearing portion of a mixing portion which mixes binary developing powder containing toner and carrier, a surface portion of a roller for forming the binary developing powder as a thin film and/or the like. This friction heat may cause the toner to be molten.

Similarly, the exposing portion scans a surface of the photosensitive drum using laser beam, by driving a polygon motor to rotate a polygon mirror rapidly, to form an electrostatic latent image on the surface of the photosensitive drum. Since the polygon motor rotates rapidly in this moment, a load of the polygon motor increases so that its temperature rises. As a result thereof, a temperature difference occurs in respective exposing paths. This temperature difference may cause the exposing position to be made different from the normal one, which degrades color reproduction.

Accordingly, the past image forming apparatus is provided with a cooling path for taking the air thereinto and/or a cooling member such as a cooling fan or the like, which prevent a temperature within the apparatus from rising. For example, a passage is provided near the developing portion and by taking the air into the apparatus via this passage, the developing portion is cooled. The exposing portion is provided with a special passage for cooling the polygon motor that is a heat source and the polygon motor is cooled by the air taken from the special passage into the apparatus.

For example, Japanese Patent Application Publication No. 2006-343607 discloses an image forming apparatus which is provided with a passage for cooled air flowing from a surrounding area of an image writing portion toward a surrounding area of a developing portion. Particularly, three intake fans are attached to a side surface of a main body of the apparatus and the air taken into the apparatus is sent to upper and lower portions of the polygon motor in the exposing apparatus through ducts. Further, intake fans are attached to a back surface of the main body of the apparatus and the is air taken into the apparatus is sent to an exposing apparatus and/or a developing apparatus through ducts.

SUMMARY OF THE INVENTION

However, the past image forming apparatus or the image forming apparatus which has been disclosed in Japanese Patent Application Publication No. 2006-343607 has a configuration such that special cooling passages are respectively provided for the exposing portion and the developing portion and plural fans and cooling passages are provided, which causes the image forming apparatus to be large-sized. Further, the image forming apparatus which has been disclosed in Japanese Patent Application Publication No. 2006-343607 has a configuration such that the air taken into the apparatus by the cooling fans passes through the exposing portion and the air is then sent to the developing portion. This causes the heated air to be flown on the developing portion, which is made difficult to cool each component of the image forming apparatus successfully.

This invention solves the above-mentioned problem and has an object to provide an image forming apparatus which has a space-saved configuration and can cool each component of the image forming apparatus successfully.

To achieve the above-mentioned object, an image forming apparatus reflecting one aspect of the present invention contains a main body, a polygon motor, an exposing portion including the polygon motor, the exposing portion forming a latent image on an is image-supporting member based on image data by driving of the polygon motor, a developing portion that develops the latent image formed by the exposing portion using toner, and a partition member provided between the exposing portion and the developing portion, wherein the exposing portion including the polygon motor projects from the partition member to a side of the developing portion and the polygon motor is overlapped with at least a part of the developing portion on a vertical direction.

It is desirable to provide the image forming apparatus further containing an intake port provided on the main body, an intake fan attached to the intake port, which takes air into the apparatus, and an intake duct which guides the air taken into the apparatus by the intake fan to an overlap portion in which the polygon motor of the exposing portion and the developing portion are overlapped on the vertical direction, the intake duct being communicated with the intake port.

It is also desirable to provide the image forming apparatus further containing an exhaust port provided on the main body, an exhaust duct which guides air around the polygon motor of the exposing portion and the developing portion to the exhaust port, the exhaust duct being communicated with the exhaust port, and an exhaust fan which exhausts the air guided by the exhaust duct to outside, the exhaust fan being attached to the exhaust port.

It is further desirable to provide the image forming apparatus wherein the intake duct branches into a first branched intake duct which supplies the air to the polygon motor of the exposing portion and a second branched intake duct which supplies the air to the developing portion.

It is additionally desirable to provide the image forming apparatus wherein the polygon motor of the exposing portion and the developing portion are positioned so that they are away from each other with a clearance, the clearance being a passage in which the air taken into the apparatus by the intake fan is flown.

It is further desirable to provide the image forming apparatus further containing plural image forming units each for forming a color image.

On the aspect of the image forming apparatus according to the invention, the polygon motor of the exposing portion projects from the partition member toward the side of the developing portion and the polygon motor of the exposing portion is overlapped with at least a part of the developing portion on a vertical direction. Accordingly, by sending the air onto the overlap portion in which the polygon motor and the developing portion are overlapped on the vertical direction, the sent air is flown against both of the polygon motor and the developing portion at the same time.

The concluding portion of this specification particularly points out and directly claims the subject matter of the present invention. However, those skilled in the art will best understand both the organization and method of operation of the invention, together with further advantages and objects thereof, by reading the remaining portions of the specification in view of the accompanying drawing(s) wherein like reference characters refer to like elements.

DESCRIPTION OF THE PREFERRED EMBODIMENTS

The following will describe embodiments of an image forming apparatus relating to the invention with reference to drawings. It is to be noted that the description in the embodiments is exemplified and any technical scope of the claims and/or meaning of term(s) claimed in the claims are not limited thereto.

First Embodiment

[Configuration Example of Color Image Forming Apparatus according to First Embodiment]

The color image forming apparatus 100 contains projection portions 3Ym, 3Mm, 3Cm and 3Km each including polygon motor 30Y, 30M, 30C or 30K of an exposing portion 3Y, 3M, 3C or 3K and developing portions 4Y, 4M, 4C and 4K. The projection portions 3Ym, 3Mm, 3Cm and 3Km and the developing portions 4Y, 4M, 4C and 4K are arranged so that each of the projection portions 3Ym, 3Mm, 3Cm and 3Km is mutually overlapped with at least a part of each of the developing portions 4Y, 4M, 4C and 4K on a vertical direction (upper and lower directions shown in FIGS. 2 and 3). This enables an cooling area to which the air hits to be made space-saved, thereby allowing any heat source such as the polygon motors 30Y, 30M, 30C and 30K and the developing portions 4Y, 4M, 4C and 4K to be efficiently cooled.

Figure 1:
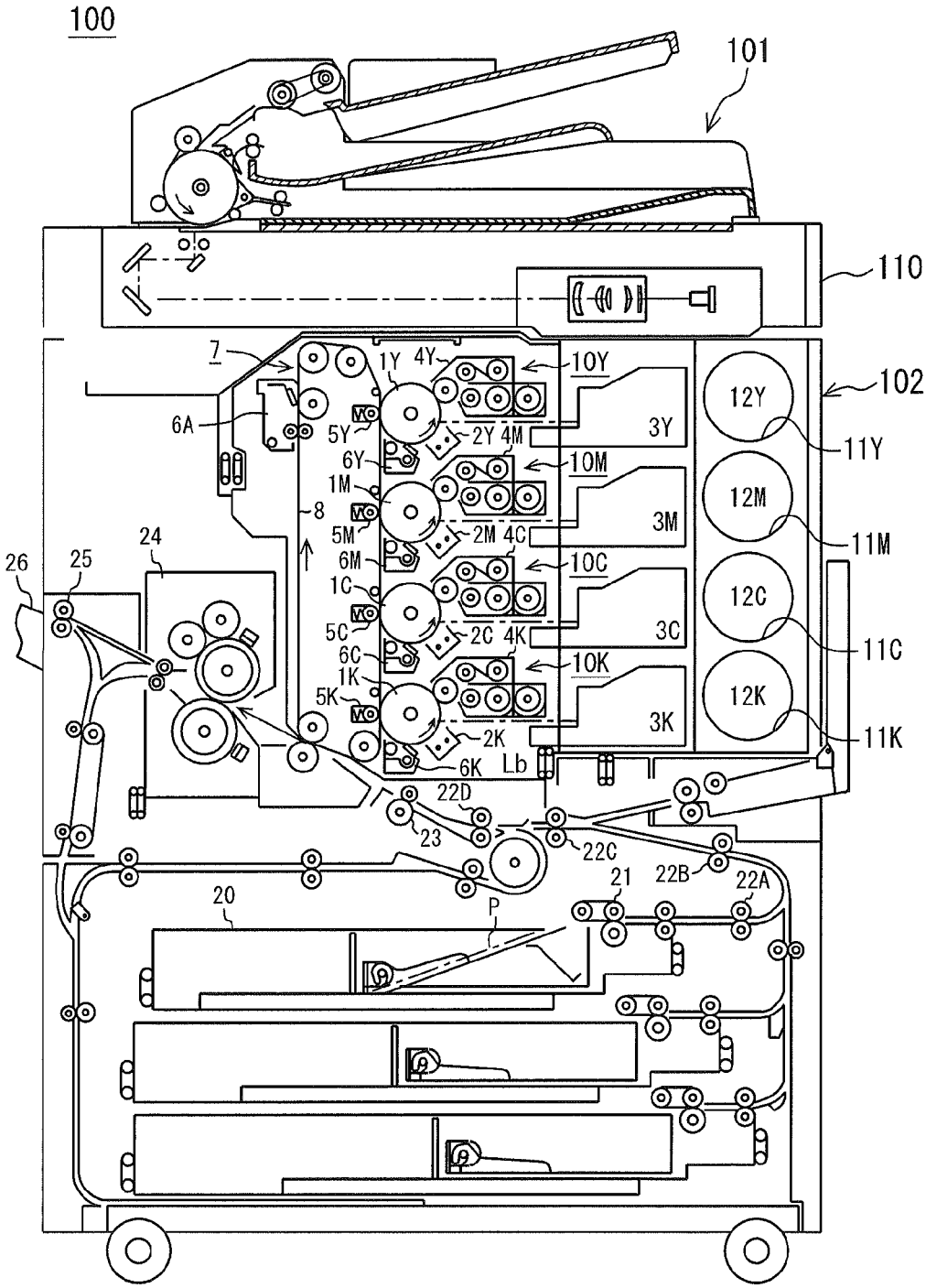
FIG. 1 is a drawing showing a configuration example of a color image forming apparatus according to a first embodiment of this invention.

The color image forming apparatus 100 is referred to as "an image forming apparatus of tandem type" as shown in FIG. 1. The color image forming apparatus 100 contains an automatic document feeder 101 and a main body 102 of the image forming apparatus. The automatic document feeder 101 is mounted on the main body 102. The automatic document feeder 101 feeds documents P, which are mounted on a document mounter, on a one-by-one basis to the main body 102 of the image forming apparatus by transfer rollers or the like with the documents F being separated.

The main body 102 of the image forming apparatus contains a document-reading unit 110, an image forming portion 60, an intermediate transfer belt 8 and a fixing unit 24.

The image-reading unit 110 irradiates light onto a document mounted on the document mounter and scans an image of the document using optics of a scan and exposure unit. The image-reading unit 110 then performs photoelectric conversion on the scanned image of the document using a charge-couple device (CCD) image sensor to obtain an image information signal. An image processing unit, not shown, performs various kinds of processing such as analog processing, analog/digital (A/D) conversion, shading compensation, compression and the like on the image information signal to output the processed signal to the image forming portion 60.

The image forming portion 60 forms an image under an electrophotographic system. The image forming portion 60 includes an image forming unit 10Y which forms a yellow (Y) image, an image forming unit 10M which forms a magenta (M) image, an image forming unit 100 which forms a cyan (C) image and an image forming unit 10K which forms a black (K) image. In this embodiment, symbols Y, M, C and K each indicating a color to be formed are respectively attached to the common functional numerals, for example, numeral 10.

The image forming unit 10Y contains a photosensitive drum 1Y, a charging portion 2Y positioned around the photosensitive drum 1Y, an exposing (writing) portion 3Y, a developing portion 4Y and a cleaning portion 6Y. The image forming unit 10M contains a photosensitive drum 1M, a charging portion 2M positioned around the photosensitive drum 1M, an exposing portion 3M, a developing portion 4M and a cleaning portion 6M. The image forming unit 10C contains a photosensitive drum 10, a charging portion 2C positioned around the photosensitive drum 10, an exposing portion 3C, a developing portion 4C and a cleaning portion 6C. The image forming unit 10K contains a photosensitive drum 1K, a charging portion 2K positioned around the photosensitive drum 1K, an exposing portion 3K, a developing portion 4K and a cleaning portion 6K.

Figure 2:
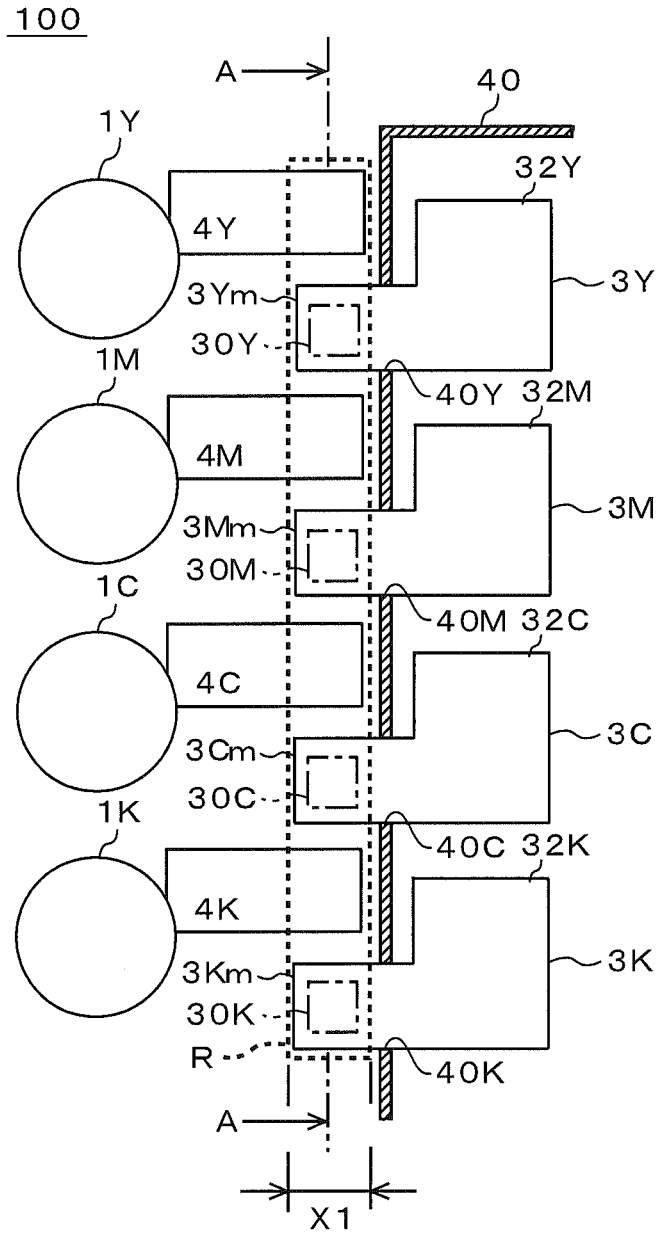
FIG. 2 is a diagram schematically illustrating a configuration example of an exposing portion and a developing portion.
Figure 3:
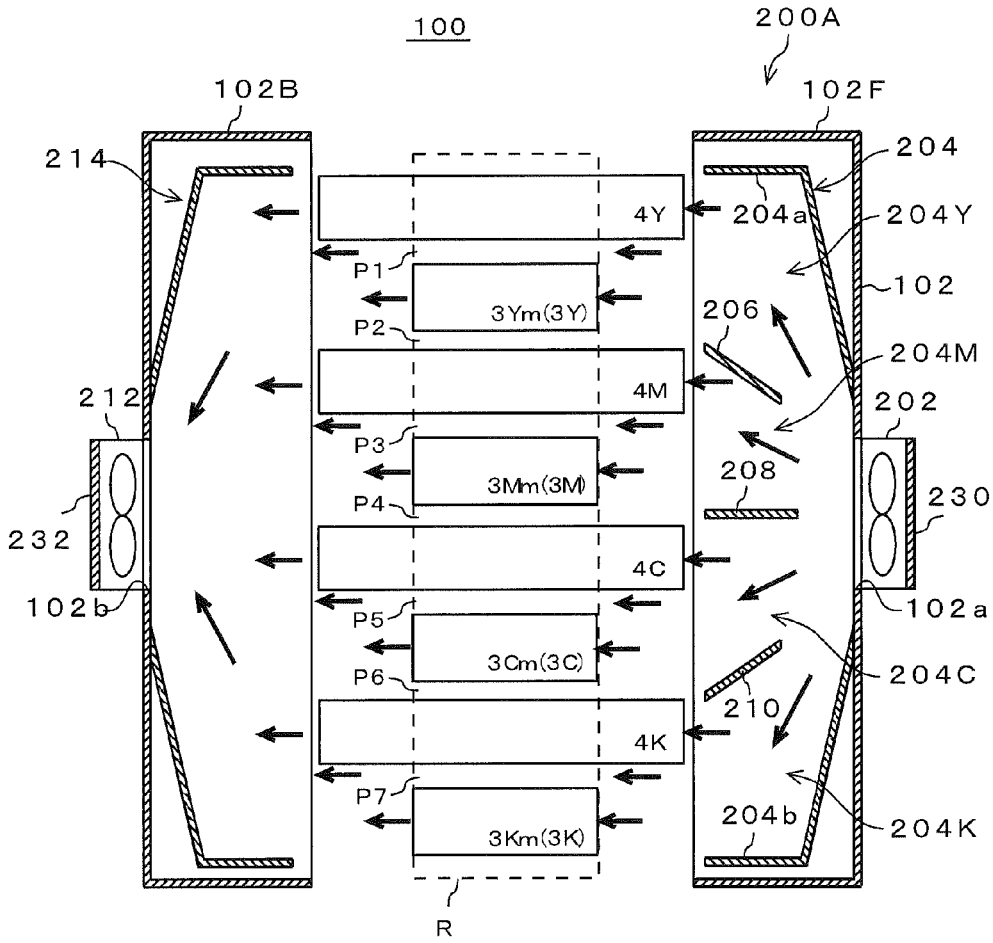
FIG. 3 is a sectional view of the exposing portion and the developing portion, taken along lines A-A shown in FIG. 2.

In this invention, each of the projection portions 3Ym, 3Mm, 3Cm and 3Km each including polygon motor 30Y, 30M, 30C or 30K constituting an exposing portion 3Y, 3M, 3C or 3K is arranged so as to be overlapped with at least a part of each of the developing portions 4Y, 4M, 4C and 4K on a vertical direction, as shown in FIGS. 2 and 3. A detailed description thereof will be described later.

Toner containers 11Y, 11M, 11C and 11K for containing nearly cylinder shaped toner bottles 12Y, 12M, 12C and 12K, respectively, which contain toners of respective colors are provided at a side end of the main body 102 of the image forming apparatus and at positions adjacent to the respective exposing portions 3Y, 3M, 3C and 3K. The toner bottles 12Y, 12M, 12C and 12K of respective colors are detachably fitted to the toner containers 11Y, 11M, 11C and 11K, respectively.

The toners contained in the toner bottles 12Y, 12M, 12C and 12K are supplied to the corresponding developing portions 4Y, 4M, 4C and 4K through supplying portions, not shown.

The photosensitive drums (image-supporting members) 1Y, 1M, 10 and 1K, the charging portions 2Y, 2M, 2C and 2K, the exposing portions 3Y, 3M, 3C and 3K, the developing portions 4Y, 4M, 4C and 4K and the cleaning portions 6Y, 6M, 6C and 6K in the image forming units 10Y, 10M, 100 and 10K respectively have common configuration in each color. The following will indicate them without attaching Y, M, C and K thereto apart from cases in which any differentiation is required.

The charging portions 2 charge a static charge uniformly around surfaces of the photosensitive drums 1. Each of the exposing portions 3 is composed of, for example, a laser scan and exposure unit of polygon mirror system. The exposing portions 3 scan surfaces of the photosensitive drums 1 using laser beam based on the image information signal to form an electrostatic latent image. The developing portions 4 develop the electrostatic latent images formed on the surfaces of the photosensitive drums 1 by using the toners. Accordingly, visible toner images are formed on the photosensitive drums 1.

The intermediate transfer belt 8 is stretched across plural rollers so as to able to run around them. When driving primary transfer rollers 5, the intermediate transfer belt 8 runs and the toner images formed on the respective photosensitive drums 1 are transferred onto their image transfer positions of the intermediate transfer belt 8 (primary transfer).

The feeder 20 includes plural feeding trays containing sheets of paper with various kinds of sheet sizes such as A3 and A4. The feeder 20 sends the sheet of paper P, which is transported from any of the feeding trays using the conveyor rollers 21, 22A, 22B, 22C and the like, to a secondary transfer portion at a desired timing after registration rollers 23 have corrected a skew or the like of the sheet of paper P. The secondary transfer portion transfers a color image collectively, which has been transferred to the image forming position of the intermediate transfer belt 8, on a surface of the sheet of paper P transported from the feeder 20 (secondary transfer). The sheet of paper P which has been secondarily transferred is transported to the fixing unit 24.

The fixing unit 24 fixes the color image on the sheet of paper P by applying pressure to the sheet of paper P onto which the color image is transferred and/or heating the same. The sheet of paper P fixed by the fixing unit 24 is ejected by paper ejection rollers 25 to a paper ejection tray 26. Further, the color image forming apparatus 100 is provided with a sheet inversion portion 27 for forming images on both sides of the sheet of paper P. The sheet of paper P, which the fixing unit 24 has fixed, is transported into the sheet inversion portion 27 where the sheet of paper P is inverted and then, transported to the secondary transfer portion again. In the secondary transfer portion, the other color image is transferred to a back surface of the sheet of paper P to form the image on the back surface of the sheet of paper P.

[Configuration Example of Exposing Portion and Developing Portion]

FIG. 2 illustrates a configuration example of the exposing portions 3Y, 3M, 3C and 3K and the developing portions 4Y, 4M, 4C and 4K. FIG. 3 shows a section of the exposing portions 3Y, 3M, 3C and 3K and the developing portions 4Y, 4M, 4C and 4K, taken along lines A-A shown in FIG. 2 on an overlap portion R of the projection portions 3Ym, 3Mm, 3Cm and 3Km and the developing portions 4Y, 4M, 4C and 4K on a vertical direction. It is to be noted that in FIG. 2, a cooling portion 200A is omitted for convenience' sake. In FIG. 3, a right side of the drawing is a front side of the color image forming apparatus 100 and a left side of the drawing is a back side of the color image forming apparatus 100.

As shown in FIG. 2, a partition member 40 extends between the exposing portion 3Y and the developing portion 4Y, between the exposing portion 3M and the developing portion 4M, between the exposing portion 3C and the developing portion 4C and between the exposing portion 3K and the developing portion 4K, respectively. The partition member 40 is made of metallic material or resin material and is a flat board. The partition member 40 partitions a region between the space in which the exposing portions 3Y, 3M, 3C and 3K are positioned and the space in which the developing portions 4Y, 4M, 4C and 4K are positioned. The partition member 40 positions the exposing portions 3Y, 3M, 3C and 3K. Accordingly, it is possible to prevent any heat generated on the exposing portions 3Y, 3M, 3C and 3K and the developing portions 4Y, 4M, 4C and 4K and foreign matters from being conducted and entered to an adjacent space. Although the partition member 40 is shown in FIG. 2 so as to be opened, it may be configured so as to be closed like a room.

The partition member 40 has plural openings 40Y, 40M, 40C and 40K for inserting the projection portions 3Ym, 3Mm, 3Cm and 3Km of the exposing portions 3Y, 3M, 3C and 3K, which will be described later. The openings 40Y, 40M, 40C and 40K are respectively formed in the partition member 40 so that when the exposing portions 3Y, 3M, 3C and 3K are attached to the partition member 40, exits for laser beam of the exposing portions 3Y, 3M, 3C and 3K face the photosensitive drums 1Y, 1M, 10 and 1K.

Each of the exposing portions 3Y, 3M, 3C and 3K is provided with a polygon mirror, a polygon motor, a laser oscillator, collimating lenses and a case 32Y, 32M, 32C or 32K containing these components. It is to be noted that the following will describe the exposing portion 3Y and the developing portion 4Y of yellow. The exposing portion 3M and the developing portion 4M of magenta, the exposing portion 3C and the developing portion 4C of cyan and the exposing portion 3K and the developing portion 4K of black have respectively the same function and configuration as those of the exposing portion 3Y and the developing portion 4Y of yellow, a detailed description of which will be omitted. The case 32Y is a container having a nearly rectangular shape and has the projection portion 3Ym which projects to a side of the developing portion 4Y and under the developing portion 4Y. The projection portion 3Ym contains a polygon motor 30Y.

When installing the exposing portion 3Y, the projection portion 3Ym of the exposing portion 3Y is inserted into the corresponding opening 40Y formed on the partition member 40 and is attached and fixed thereon with the projection portion 3Ym projecting from a surface of the partition member 40 toward a side of the developing portion 4Y. In this moment, the projection portion 3Ym is arranged so as to be positioned between the developing portions 4Y and 4M and to be overlapped with an end of he developing portion 4Y at a side of the exposing portion 3Y on a vertical direction. As viewed from a front side of the color image forming apparatus 100, the projection portions 3Ym, 3Mm, 3Cm and 3Km of the exposing portions 3Y, 3M, 3C and 3K and the ends of the developing portions 4Y, 4M, 4C and 4K are mutually arranged on the upper and lower (vertical) direction. In this embodiment, a region where the exposing portions 3Y, 3M, 3C and 3K and the developing portions 4Y, 4M, 4C and 4K are mutually arranged is referred to as "overlap portion R" (illustrated by dotted line in FIG. 2).

As shown in FIG. 3, the projection portion 3Ym is arranged so as to have a predetermined space (a clearance) between the projection portion 3Ym and each of the developing portions 4Y and 4M. Accordingly, a passage P1 for allowing the air to be passed through is formed between an upper surface of the projection portion 3Ym and a lower surface of the developing portion 4Y. A passage P2 for allowing the air to be passed through is also formed between a lower surface of the projection portion 3Ym and an upper surface of the developing portion 4M. Similarly, the projection portion 3Mm is arranged so as to have a predetermined space between the projection portion 3Mm and each of the developing portions 4M and 4C. Accordingly, a passage P3 for allowing the air to be passed through is formed between an upper surface of the projection portion 3Mm and a lower surface of the developing portion 4M. A passage P4 for allowing the air to be passed through is also formed between a lower surface of the projection portion 3Mm and an upper surface of the developing portion 4C. Further, the projection portion 3Cm is arranged so as to have a predetermined space between the projection portion 3Cm and each of the developing portions 4C and 4K. Accordingly, a passage P5 for allowing the air to be passed through is formed between an upper surface of the projection portion 3Cm and a lower surface of the developing portion 4C. A passage P6 for allowing the air to be passed through is also formed between a lower surface of the projection portion 3Cm and an upper surface of the developing portion 4K. Additionally, the projection portion 3Km is arranged so as to have a predetermined space between the projection portion 3Km and the developing portion 4K. Accordingly, a passage P7 for allowing the air to be passed through is formed between an upper surface of the projection portion 3Km and a lower surface of the developing portion 4K.

The color image forming apparatus 100 also contains a cooling portion 200A for cooling the exposing portions 3Y, 3M, 3C and 3K and the developing portions 4Y, 4M, 4C and 4K, as shown in FIG. 3. The cooling portion 200A includes an intake fan 202, an intake duct 204, an exhaust fan 212 and an exhaust duct 214. The intake fan 202 is detachably attached to an intake port 102*a* formed in the front portion 102F of the main body 102 of the image forming apparatus so as to correspond to the overlap portion R in which the projection portions 3Ym, 3Mm, 3Cm and 3Km and the developing portions 4Y, 4M, 4C and 4K are overlapped on a vertical direction. The intake fan 202 is composed of, for example, a propeller fan, a sirocco fan or the like. A filter member 230 for removing any dusts and/or any foreign matters from the air is installed at an outer surface side of the intake fan 202. Passing the air through the filter member 230 enables the air to be cleaned so that the cleaned (cooled) air is supplied into the main body 102 of the image forming apparatus.

The intake duct 204 is provided inside the front portion 102F of the main body 102 of the image forming apparatus. The intake duct 204 guides the air taken into the main body 102 of the image forming apparatus from the intake port 102*a* communicated thereto by the intake fan 202 to the overlap portion R in the main body 102 of the image forming apparatus. The intake duct 204 is composed of, for example, resin material, metallic material or the like. The intake duct 204 has a width having a length which is selected so as to be almost the same as a length X1 of the overlap portion R along the width direction thereof. The intake duct 204 has an entrance shape which is formed so as to be almost the same as an opening shape of the intake port 102*a*. The intake duct 204 has an exit shape which is formed so as to correspond to the overlap portion R. For example, an exit shape of the intake duct 204 is formed so as to be almost the same as that of the overlap portion R indicated by the dotted line shown in FIG. 2. This enables the air taken into the main body 102 of the image forming apparatus by the intake fan 202 to be supplied to whole of the overlap portion R (the projection portions 3Ym, 3Mm, 3Cm and 3Km and the developing portions 4Y, 4M, 4C and 4K) long extending on upper and lower directions (on a vertical direction) uniformly.

Baffle plates 206, 208 and 210 each adjusting a flown direction of the air taken into the main body 102 of the image forming apparatus by the intake fan 202 are provided within the intake duct 204. The baffle plate 206 is provided between the exposing portion 3Y and the developing portion 4M. The baffle plate 206 and an outer plate 204*a* of the intake duct 204 constitute a branch duct 204Y to send the air to the exposing portion 3Y and the developing portion 4M. The baffle plate 208 is provided between the exposing portion 3M and the developing portion 4C. The baffle plates 206, 208 constitute a branch duct 204M to send the air to the exposing portion 3M and the developing portion 4M. The baffle plate 210 is provided between the exposing portion 3C and the developing portion 4K. The baffle plates 208, 210 constitute a branch duct 204C to send the air to the exposing portion 3C and the developing portion 4C. The baffle plate 210 and an outer plate 204*b* of the intake duct 204 constitute a branch duct 204K to send the air to the exposing portion 3K and the developing portion 4K.

The exhaust fan 212 is detachably attached to an exhaust port 102*b* formed in the back surface portion 102B of the main body 102 of the image forming apparatus so as to correspond to the overlap portion R of the projection portions 3Ym, 3Mm, 3Cm and 3Km and the developing portions 4Y, 4M, 4C and 4K on a vertical direction. The exhaust fan 212 is composed of, for example, a propeller fan, a sirocco fan or the like. A filter member 232 for removing any dusts and/or any foreign matters from the air is installed at an outer surface side of the exhaust fan 212. This enables any foreign matters to be removed from the air within the main body 102 of the image forming apparatus and enables the removed air to be exhausted to outside.

The exhaust duct 214 is provided inside the back surface portion 102B of the main body 102 of the image forming apparatus. The intake duct 204 guides the air passed through the passages P1 through P7 and the air around the projection portions 3Ym, 3Mm, 3Cm and 3Km and the developing portions 4Y, 4M, 4C and 4K to the exhaust duct 212. The exhaust duct 214 is composed of, for example, resin material, metallic material or the like. The exhaust duct 214 has a width having a length which is selected so as to be almost the same as the length X1 of the overlap portion R along the width direction thereof. The exhaust duct 214 has an entrance shape which is formed so as to correspond to the overlap portion R. For example, an entrance shape of the exhaust duct 214 is formed so as to be almost the same as that of the overlap portion R indicated by the dotted line shown in FIG. 2. The exhaust duct 214 has an exit shape which is formed so as to be almost the same as an opening shape of the exhaust port 102*b*. This enables the air around the overlap portion R long extending on upper and lower directions to be efficiently taken therein so that the taken air is exhausted to outside by the exhaust fan 212.

[Block Configuration of Color Image Forming Apparatus]

Figure 4:
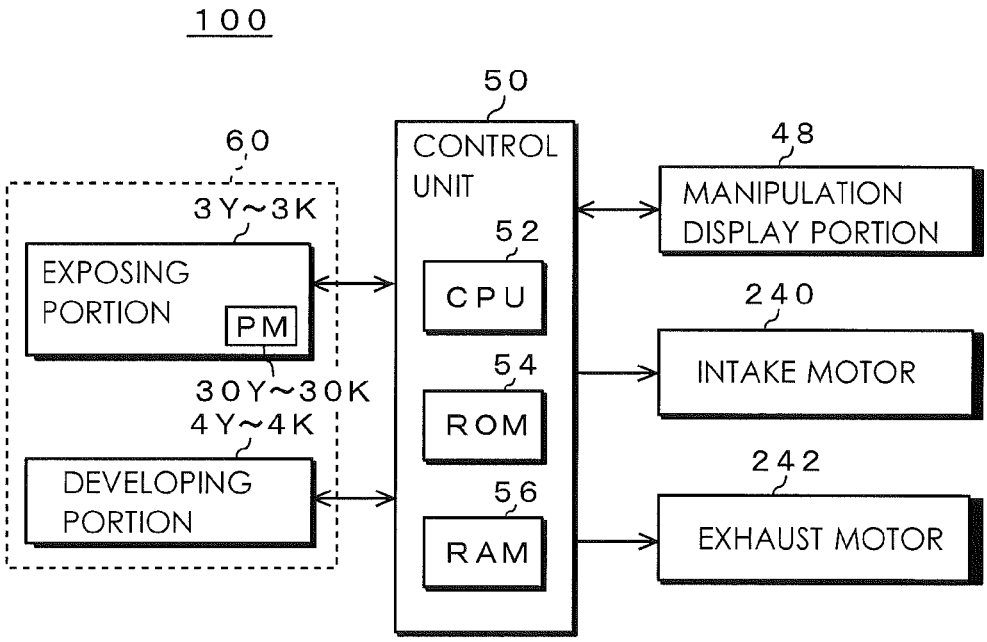
FIG. 4 is a block diagram of the image forming apparatus for showing a configuration example thereof.

FIG. 4 illustrates a block configuration example of the color image forming apparatus 100. As shown in FIG. 4, the color image forming apparatus 100 contains a control unit 50 controlling an operation of whole of the color image forming apparatus 100. The controller 50 includes a central processing unit (CPU) 52, a read only memory (ROM) 54 and a random access memory (RAM) 56. The CPU 52 performs an image forming process and the cooling processing in the apparatus by reading any programs stored in the ROM 54 and extracting the programs in the RAM 54 to execute them.

The control unit 50 connects a manipulation display portion 48, the image forming portion 60, an intake motor 240 and an exhaust motor 242, respectively.

The manipulation display unit 48 is composed of, for example, a touch panel combining a position detection device of capacitive sensing system or resistive film system with a display device composed of liquid crystal or the like. The manipulation display unit 48 is provided on an upper front portion of the main body 102 of the image forming apparatus. The manipulation display unit 48 receives various kinds of conditions when performing the image forming process and a start or stop of the cooling operation in the apparatus and generates a manipulation signal corresponding to the received input information to supply the signal to the control unit 50.

The image forming portion 60 includes the exposing portions 3Y, 3M, 3C and 3K, the developing portions 4Y, 4M, 4C and 4K and the like. The exposing portions 3Y, 3M, 3C and 3K respectively have polygon motors 30Y, 30M, 30C and 30K. The exposing portions 3Y, 3M, 3C and 3K respectively drive the polygon motors 30Y, 30M, 30C and 30K based on the instruction from the control unit 50 to rotate the polygon mirrors, thereby scanning a surface of each of the photosensitive drums 1Y, 1M, 10 and 1K to form latent images. The developing portions 4Y, 4M, 4C and 4K respectively supply toners to photosensitive drums 1Y, 1M, 10 and 1K based on the instruction from the control unit 50 to form toner images corresponding to the latent images on the photosensitive drums 1Y, 1M, 1C and 1K.

The intake motor 240 drives under the control based on the instruction from the control unit 50 to rotate the intake fan 202 connected to the intake motor 240 or stop its rotation. The exhaust motor 242 drives under the control based on the instruction from the control unit 50 to rotate the exhaust fan 212 connected to the exhaust motor 242 or stop its rotation. The intake motor 240 and the exhaust motor 242 are respectively composed of, for example, a stepping motor and the like.

[Operation Example of Image Forming Apparatus]

When the color image forming apparatus 100 is turned on, the control unit 50 is triggered and supplies driving signals to the intake motor 240 and the exhaust motor 242. The intake motor 240 and the exhaust motor 242 drive based on any instruction of the control unit 50 to rotate the intake fan 202 and the exhaust fan 212. A start timing of cooling operation may be set such that an icon for indicating on/off of the cooling operation is displayed on a manipulation screen of the manipulation display portion 48 and when a user selects the icon, the intake fan 202 and the exhaust fan 212 rotate to start the cooling operation. Further, a start timing of cooling operation may be set such that when the printing job actually starts, the cooling operation starts.

When the intake fan 202 operates, the air is taken into the main body 102 of the image forming apparatus via the intake port 102*a*. The taken air branches into the branch ducts 204Y, 204M, 204C and 204K, respectively, and passes through the branch ducts 204Y, 204M, 204C and 204K to flow against front ends of the projection portions 3Ym, 3Mm, 3Cm and 3Km of the exposing portions 3Y, 3M, 3C and 3K and the developing portions 4Y, 4M, 4C and 4K, which are positioned at a downstream side thereof.

Since the air, thus, directly flows against the projection portions 3Ym, 3Mm, 3Cm and 3Km, which include the polygon motors 30Y, 30M, 30C and 30K that have the highest temperature in the exposing portions 3Y, 3M, 3C and 3K, it is possible to cool the polygon motors 30Y, 30M, 300 and 30K successfully and efficiently. Further, although the air cools only the ends of the developing portions 4Y, 4M, 4C and 4K at sides of the exposing portions 3Y, 3M, 3C and 3K, because toners or the like circulate in the developing portions 4Y, 4M, 4C and 4K by any mixing means or the like, the toners cooled at the ends of the developing portions 4Y, 4M, 4C and 4K circulate in the developing portions 4Y, 4M, 4C and 4K, so that whole of the toners in each of the developing portions 4Y, 4M, 4C and 4K can be cooled.

The air taken into the main body 102 of the image forming apparatus also passes through the passages P1 through P7 which are respectively formed between each of the projection portions 3Ym, 3Mm, 3Cm and 3Km and each of the developing portions 4Y, 4M, 4C and 4K. This air contains the air which is flown against the front portions of the projection portions 3Ym, 3Mm, 3Cm and 3Km and the developing portions 4Y, 4M, 4C and 4K to flow around them. This enables the upper and lower surfaces of the projection portions 3Ym, 3Mm, 3Cm and 3Km in which the polygon motors 30Y, 30M, 30C and 30K are respectively included, and the upper and lower surfaces of the developing portions 4Y, 4M, 4C and 4K to be cooled by the air passed through the passages P1 through P7.

The exhaust fan 212 takes the air flown into the passages P1 through P7 and the air around them into the exhaust duct 214 positioned at the back side of the main body 102 of the image forming apparatus. The air taken into the exhaust duct 214 is exhausted to outside through the exhaust port 102*b* by the exhaust fan 212.

As described above, in the first embodiment, since the projection portions 3Ym, 3Mm, 3Cm and 3Km in which the polygon motors 30Y, 30M, 30C and 30K are respectively included, and the developing portions 4Y, 4M, 4C and 4K are arranged so that they are mutually overlapped on the upper and lower (vertical) direction, it is possible to make the cooling region decreased and limited to the overlap portion R. Further, in the first embodiment, since the opening of the intake duct 204 is formed so that the shape thereof is almost the same as the shape of the overlap portion R, it is possible to send the air to this overlap portion R efficiently. This enables the air to be flown against all of the projection portions 3Ym, 3Mm, 3Cm and 3Km and the developing portions 4Y, 4M, 4C and 4K at the same time. Accordingly, it is possible to cool the polygon motors 30Y, 30M, 30C and 30K and the developing portions 4Y, 4M, 4C and 4K successfully and efficiently.

Since a pair of the intake fan 202 and the intake duct 204 can cool the exposing portions 3Y, 3M, 3C and 3K and the developing portions 4Y, 4M, 4C and 4K, it is not required to provide a cooling fan and a cooling path independently for each of the exposing portions 3Y, 3M, 3C and 3K and the developing portions 4Y, 4M, 4C and 4K. This enables an installed space of the cooling fan and the like to be reduced.

When the toner containers 11Y, 11M, 11C and 11K are provided at a side end of the main body 102 of the image forming apparatus in order to make the apparatus small-sized, if the air is sent from a side surface portion of the main body 102 of the image forming apparatus as the conventional one, the toners may be dispersed under any influence of sending the air. On the other hand, according to this invention, since it is possible to send the air from the front surface side of the main body 102 of the image forming apparatus by providing the overlap portion R, even when the toner containers 11Y, 11M, 11C and 11K are provided at a side end of the main body 102 of the image forming apparatus, it is possible to prevent the toners from being dispersed under any influence of sending the air. It is also possible to make the color image forming apparatus 100 small-sized.

Second Embodiment

The second embodiment is different from the first embodiment in that in a cooling portion 200B, each passage in the intake duct 204 diverges into a side of the exposing portion 3 and a side of the developing portion 4. It is to be noted that other components and operations of the color image forming apparatus 100 in this embodiment are identical to those of the first embodiment so that the identical components are indicated by the same reference numbers, a detailed explanation of which will be omitted.

Figure 5:
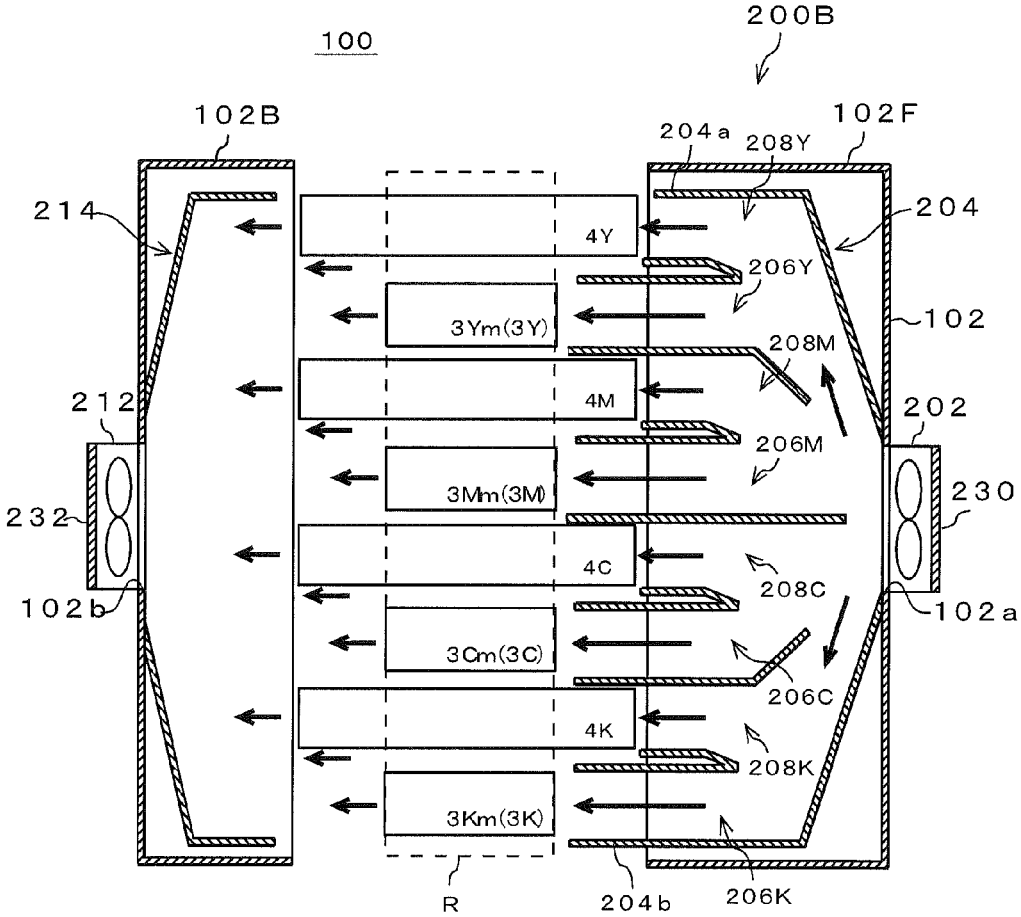
FIG. 5 is a diagram schematically illustrating a configuration example of a cooling portion of a color image forming apparatus according to a second embodiment of this invention.

FIG. 5 shows a configuration example of the cooling portion 200B of the image forming apparatus according to a second embodiment of this invention. As shown in FIG. 5, the intake duct 204 contains exposing portion ducts 206Y, 206M, 206C and 206K for sending the air each exposing portion 3Y, 3M, 3C or 3K and developing portion ducts 208Y, 208M, 2080 and 208K for sending the air each developing portion 4Y, 4M, 4C or 4K. It is to be noted that the exposing portion ducts 206Y, 206M, 206C and 206K constitute a first branched intake duct and the developing portion ducts 208Y, 208M, 208C and 208K constitute a second branched intake duct.

Each of the exposing portion ducts 206Y, 206M, 206C and 206K is formed so as to have a length of passage that is longer than a length of passage of each of the developing portion ducts 208Y, 208M, 208C and 208K. Each of the exposing portion ducts 206Y, 206M, 206C and 206K extends up to an adjacent position of each of the exposing portions 3Y, 3M, 3C and 3K. Such a configuration allows the air to surely flow against the exposing portions 3Y, 3M, 3C and 3K, which are positioned deeper than the developing portions 4Y, 4M, 4C and 4K.

The air taken into the main body 102 of the image forming apparatus by the intake fan 202 almost evenly branches into the exposing portion ducts 206Y, 206M, 206C and 206K and the developing portion ducts 208Y, 208M, 208C and 208K, respectively. The branched air flows into the exposing portion ducts 206Y, 206M, 206C and 206K and the developing portion ducts 208Y, 208M, 208C and 208K to directly flow against the projection portions 3Ym, 3Mm, 3Cm and 3Km, which include the polygon motors 30Y, 30M, 30C and 30K, of the exposing portions 3Y, 3M, 3C and 3K and the developing portions 4Y, 4M, 4C and 4K, which are positioned at a downstream side thereof. This enables the exposing portions 3Y, 3M, 3C and 3K and the developing portions 4Y, 4M, 4C and 4K to be cooled.

The exhaust fan 212 drives to take the air around the exposing portions 3Y, 3M, 3C and 3K and the developing portions 4Y, 4M, 4C and 4K into the exhaust duct 214. The air taken into the exhaust duct 214 is exhausted to outside through the exhaust port 102*b*.

As described above, according to the second embodiment, it is possible to get the same excellent effects as those of the above-mentioned first embodiment. Further, according to the second embodiment, since the exposing portion ducts 206Y, 206M, 206C and 206K and the developing portion ducts 208Y, 208M, 208C and 208K for directly supplying the air to the exposing portions 3Y, 3M, 3C and 3K and the developing portions 4Y, 4M, 4C and 4K are provided for each of the exposing portions 3Y, 3M, 3C and 3K and the developing portions 4Y, 4M, 4C and 4K, it is possible to supply the air surely to the exposing portions 3Y, 3M, 3C and 3K and the developing portions 4Y, 4M, 4C and 4K, respectively. As a result thereof, it is possible to cool the apparatus successfully and efficiently.

This invention is applicable to the image forming apparatus which forms an image on a sheet of paper and is capable of being cooled.

Although the present invention has been described with reference to the embodiments above, it is to be noted that the present invention is not limited to the embodiments, and various changes and modifications are possible to those who are skilled in the art insofar as they are within the scope of the invention. Although in the above-mentioned first and second embodiments, it has been described that the intake fan 202 is provided at the front side of the main body 102 of the image forming apparatus, the present invention is not limited thereto. For example, the intake fan 202 may be provided at the side surface side of the main body 102 of the image forming apparatus. In this case, the intake duct 204 extends from the side surface side of the main body 102 of the image forming apparatus to the front side thereof and the air taken into the main body 102 of the image forming apparatus by the intake fan 202 is sent to the overlap portion R through the intake duct 204.

For on/off control of the cooling operation, a temperature sensor may be provided within the main body 102 of the image forming apparatus. When a measured result of the temperature in the main body 102 of the image forming apparatus exceeds a predetermined threshold value, the intake fan 202 and the exhaust fan 212 may drive and rotate to start the cooling operation.

Further, although in the above-mentioned first and second embodiments, it has been described that the intake duct 204 branches into plural passages, the present invention is not limited thereto. For example, the exhaust duct 214 may branch into plural passages.

It should be understood by those skilled in the art that various modifications, combinations, sub-combinations and alterations may occur depending on design requirements and other factors insofar as they are within the scope of the appended claims or the equivalents thereof.

What is claimed is:

1. An image forming apparatus comprising:

a main body;

a plurality of exposing portions each including a polygon motor, each exposing portion forming a latent image on an image-supporting member based on image data by driving of the polygon motor;

a plurality of cases each housing one of the plurality of exposing portions;

a plurality of developing portions that develops the latent images formed by the plurality of exposing portions using toner; and a partition member that divides a space in which the plurality of cases is provided from a space in which the plurality of developing portions is provided, the partition member being provided between the space in which the plurality of cases is provided and the space in which the plurality of developing portions is provided, wherein the plurality of cases provide polygon motors at projecting portions projecting from the partition member into the space in which the plurality of developing portions are provided, the projecting portions being overlapped with at least a part of the plurality of developing portions in a vertical direction;

an intake port provided on the main body;

an intake fan attached to the intake port, which takes air into the image forming apparatus;

an intake duct which guides the air taken into the image forming apparatus by the intake fan to an overlap portion in which the projecting portions and the exposing portions are overlapped, the intake duct being communicated with the intake port;

an exhaust port provided on the main body;

an exhaust duct which guides air around the projecting portions and the developing portions to the exhaust port, the exhaust duct being communicated with the exhaust port; and an exhaust fan which exhausts the air guided by the exhaust duct outside of the image forming apparatus, the exhaust fan being attached to the exhaust port.

2. The image forming apparatus according to claim 1, wherein the intake duct branches into a first branched intake duct which supplies the air to the projecting portions and a second branched intake duct which supplies the air to the developing portions.

3. The image forming apparatus according to claim 2, further comprising plural image forming units each for forming a color image.

4. The image forming apparatus according to claim 1, wherein the projecting portions and the developing portions are positioned so that they are away from each other with clearances, the clearances being formed as a passage in which the air taken into the apparatus by the intake fan is blown.

* * * * *